US011002003B2

(12) United States Patent
Aylward et al.

(10) Patent No.: US 11,002,003 B2
(45) Date of Patent: May 11, 2021

(54) LIGHTWEIGHT STEEL PARALLEL MODULAR CONSTRUCTIONS SYSTEM WITH SYNTHETIC MODULES

(71) Applicant: Affordable Modular Systems, LLC, San Diego, CA (US)

(72) Inventors: Peter G. Aylward, San Diego, CA (US); Douglas J. McCarron, Las Vegas, NV (US); Daniel M. Odom, Lenoir City, TN (US); Brian Pierce, Knoxville, TN (US); Patrick Flood, Lenoir City, TN (US)

(73) Assignee: AFFORDABLE MODULAR SYSTEMS, LLC, San Diego, CA (US)

( * ) Notice: Subject to any disclaimer, the term of this patent is extended or adjusted under 35 U.S.C. 154(b) by 0 days.

(21) Appl. No.: 15/879,402

(22) Filed: Jan. 24, 2018

(65) Prior Publication Data

US 2018/0209136 A1 Jul. 26, 2018

Related U.S. Application Data

(60) Provisional application No. 62/449,912, filed on Jan. 24, 2017.

(51) Int. Cl.
*E04B 1/348* (2006.01)
*E04B 1/343* (2006.01)
(Continued)

(52) U.S. Cl.
CPC ..... *E04B 1/348* (2013.01); *E04B 1/3483* (2013.01); *E04B 1/34321* (2013.01); *E04B 2/74* (2013.01);
(Continued)

(58) Field of Classification Search
CPC .... E04B 1/34861; E04B 1/348; E04B 1/3483; E04B 1/34331; E04B 1/34321;
(Continued)

(56) References Cited

U.S. PATENT DOCUMENTS 3,503,170 A * 3/1970 Shelley ..... E04B 1/34823 52/745.03
4,045,937 A * 9/1977 Stucky ..... E04B 1/3483 52/745.03
4,078,345 A * 3/1978 Piazzalunga ..... E04B 1/04 52/236.9
2002/0170243 A1* 11/2002 Don ..... E04B 1/3483 52/79.7
2011/0056147 A1* 3/2011 Beaudet ..... E04B 1/3483 52/79.9
(Continued)

FOREIGN PATENT DOCUMENTS

WO 2015143566 A1 10/2015
WO WO-2017025847 A1 * 2/2017 ..... B65D 88/121

OTHER PUBLICATIONS

PCT/US2018/015108. International Search Report & Written Opinion (dated Apr. 24, 2018).
(Continued)

*Primary Examiner* — Christine T Cajilig
(74) *Attorney, Agent, or Firm* — Loza & Loza, LLP; Heidi L. Eisenhut

(57) ABSTRACT

A multi-family building structure using light weight prefabricated parallel modular living units is provided. The structure comprises at least first plurality of parallel modular living units and a second plurality of parallel modular living units. Each living unit in the first plurality of living units comprises a first outer and inner modules and a first synthetic residential module between the first outer module and the first inner module. Each living unit in the first plurality of living units comprises a second outer and outer modules and a second synthetic residential module between the second outer module and the second inner module. The structure further comprises a synthetic corridor module formed between the first inner module of the each living unit
(Continued)

in the first plurality of living units and the second inner module in the second plurality of living units.

15 Claims, 16 Drawing Sheets

(51) Int. Cl.
*E04B 2/74* (2006.01)
*E04H 1/00* (2006.01)

(52) U.S. Cl.
CPC .... *E04H 1/005* (2013.01); *E04B 2001/34884* (2013.01)

(58) Field of Classification Search
CPC ..... E04H 1/005; E04H 2001/1283; E04H 2001/34884
See application file for complete search history.

(56) References Cited

U.S. PATENT DOCUMENTS

2015/0252558 A1* 9/2015 Chin ..... E04H 9/02 52/79.7
2016/0069064 A1* 3/2016 Martin ..... E04H 1/005 52/79.7

OTHER PUBLICATIONS

Taylor. "Design for Modular Construction: An Introduction for Architects." The American Institute for Architects, National Institute of Building Sciences (Mar. 15, 2019).
Cal. Code of Regulations. "California Tax Credit Allocation Committee Regulations Implementing the Federal and State Low Income Housing Tax Credit Laws." Title 4, Div. 17, Ch. 1 (Feb. 27, 2019).

* cited by examiner

LIGHTWEIGHT STEEL PARALLEL MODULAR CONSTRUCTIONS SYSTEM WITH SYNTHETIC MODULES

CROSS REFERENCE TO RELATED APPLICATIONS

This application claims priority to a provisional application, U.S. Ser. No. 62/449,912, filed Jan. 24, 2017, entitled "Lightweight Steel Parallel Modular Construction System with Synthetic Modules".

FIELD

The present invention relates to a new and novel methodology for the fabrication and installation of modular components in the construction of buildings, such as multifamily apartment buildings.

BACKGROUND

Conventional modular systems which are used for the construction of multifamily apartments for rent or residential units for sale are known. The state of the art is best illustrated by a recently completed 118 unit apartment complex in Sacramento, Calif. called Eviva Midtown. Excerpts from a recent article on the project are set forth below:

"The modular "boxes" that make up the building measure 12×64 feet and weigh 35,000 pounds. All of Eviva's units will be stacked, one by one, atop the project's ground floor space. The "boxes", as they are known in modular parlance, will then be stitched together with mechanical, electrical, and plumbing (MEP) runs strung between them until Eviva reaches its full, six-story height. The units will arrive at the site almost completely finished out. Paint, flooring, baseboards, cabinetry, counters, lighting, faucets, showerheads [etc.] and even appliances, will all already be in place."

The modular "box" referenced in the above article and as shown in FIG. 1 is a six sided "rectangular box", known geometrically as a "right rectangular prism". The six sides of the rectangular box in FIG. 1 (and in conventional modular construction) are the four side walls, the floor, and the ceiling. Note that the modules shown and conventional modular units in general are installed and stacked in a perpendicular manner That means that the long side of the module runs perpendicular to the exterior of the building. In its 2016 Annual Report, The Modular Building Institute's design considerations for conventional modular construction was comprised of primarily four stages. The four stages included (1) design approval by the end user and any regulating authorities; (2) assembly of module components in a controlled environment; (3) transportation of modules to a final destination; and (4) erection of modular units to form a finished building. The report indicated that when designing a project, the following characteristics should be considered:

- Three Dimensional modules have widths that are typically nominal 8, 10, 12, 14, and 16 feet with 12 and 14 feet being the most common. Framing dimensions are typically 2 inches less than nominal size.
- Module lengths are up to 70 feet, usually in 2-foot increments.
- Module heights vary from approximately 11 feet, 6 inches to 13 feet, not including the height of the unit's transport trailer or frame.
- Wood-frame construction is the most common type of construction; however, manufacturers also build with steel and concrete which meets the requirements for Type-I, -II, and -III construction.
- Multistory modular buildings can be built up to the maximum stories allowed by code. A majority of modular buildings are 1 to 3 stories, but a rapidly growing trend is 4 to 8 story facilities. A handful of projects have exceeded 15 stories in the U.K. and U.S., including the tallest modular building at 32 stories.
- Restroom areas should be designed so that a module "marriage line" does not split the space.
- Multiple roof-framing styles are available. Some styles can be completed in the factory and some may require the installation of trusses onsite.
- Modular buildings can be configured using modules of various lengths and widths.

When a conventional six-sided rectangular box is stacked next to another similar module, since each of the two modules units have abutting side walls, one of the side walls will be redundant. Likewise, when a conventional six-sided rectangular box is stacked on top of another similar module, since the bottom module has a ceiling and the top module has a floor, either the floor or the ceiling will be redundant.

Light Gauge Panelized Wall Framing—State of the Art

In order to fully understand the momentous technology of the Applicant's new light gauge steel modular housing system, one must first understand the history of the steel stud, and then how those steel studs morphed into the sophisticated structural steel wall panels now in existence. Finally those structural steel wall panels morphed into the first ever modular housing units comprised totally of light gauge metal framing components.

By the 1930s building codes contained specifications for hot rolled steel building components. However, standards for cold formed steel products having a width of $3/16^{th}$ of an inch or less (i.e., light gauge steel) were not adopted until 1946. The cold formed steel process turns light gauge sheet steel into shapes and sizes which mimic dimensional lumber (e.g., 2×4s, 2×6s, etc.). Light gauge steel framing members such as studs (i.e., an upright support in the wall of a building to which sheathing or drywall is attached) were formed in a roll forming machine by passing thin sheet steel through a series of rollers to form the bends that make the desired shape of the end product. Because this process is done without heat (hence the description "cold formed") the studs produced are stronger than the original sheet steel. The metal studs and tracks first produced and used commercially had shapes as indicated on FIG. 2 and FIG. 3, while the connections of the studs to the top and bottom tracks is illustrated in FIG. 4. The horizontal tracks are anchored to the floor and ceiling of the building. An illustration of a manually installed stud and track system is set forth in FIG. 5.

Since the walls originally constructed by this system were not structural, they could be used only for interior building partitions and could not serve as load bearing walls. This nonstructural metal wall system (See FIG. 6) quickly replaced lumber for interior partitions in buildings. Indeed, as a result of the increased construction of taller buildings in the 1950s and 1960s with life safety a paramount concern, the lightweight, non-combustible steel stud and track system increasingly replaced the conventional wood framed interior systems. (The weight of the metal stud and track system was 33% of the conventional lumber partition system.) In 2004, the Steel Framing Alliance reported that 81% of interior walls built in the U.S. used cold-formed steel framing.

As a result of improvements in the strength of the metal studs, by the 1970's building walls utilizing the stud/track system could serve as load bearing walls. Thus, these structural light gauge wall systems could be used for exterior building walls. In the 1980's, wall panel fabricators started purchasing studs and tracks and fabricating them into structural wall panels which were then transported directly to a job site. By using these prefabricated wall panels produced in a factory, no manual labor was required on the job site to assemble and connect the studs to the tracks. FIG. 7 illustrates an example of stud walls connected to ceiling panels in the construction of a building.

By 2011, the use of structural light gauge wall systems had dramatically expanded and had surpassed the steel used to manufacture nonstructural framing. The strength and ductility of structural cold formed steel framing made it the ideal material for construction in high wind speed and seismic zones in the US. Also, the non-combustibility and termite resistance of these light gauge wall panels lowered construction and ownership costs. Presently, between 30% and 35% of all nonresidential buildings in the U.S. are built with cold-formed steel structural and nonstructural framing.

While light gauge steel wall panels have been in existence for many years, until recently a roll forming machine was unable to produce large numbers of light gauge steel wall panel components which would conform to a buildings architectural layout (e.g., stud spacing requirements). The reason for this was the time consuming process of manually programing the controllers on the roll forming machines to produce the pre-engineered parts for the wall panels. Computer aided design software (i.e., CAD software) has long been used to model complex building designs with complex framing components. However, until about 10 years ago it was not possible to download these CAD models to the controller software (CNC software) embedded on the roll forming machines. At that point significant improvements were made in the automated generation of CNC software instructions from CAD building software models. Thus, large and complex building designs with thousands of unique framing components could be digitized quickly and extremely accurate sets of CNC instructions to the roll forming machines were generated automatically. This automated process integrating building design and roll forming manufacturing of the components of differing wall panels moved the light gauge cold formed steel manufacturing industry past the laborious and mistake-ridden manual programing process previously faced by the industry.

Accordingly, over the last five years several wall panel manufacturers have integrated the automated generation of CNC instructions, highly customized roll forming machines, and specific project and planning implementation resulting in the efficient large scale production of customized prefabricated wall panels. In short, the current state of the art for customized light gauge wall panels is robust and healthy. Two examples of a customized light gauge wall panel systems are set forth in FIGS. 6 and 7.

SUMMARY

The following presents a simplified summary of one or more implementations in order to provide a basic understanding of some implementations. This summary is not an extensive overview of all contemplated implementations, and is intended to neither identify key or critical elements of all implementations nor delineate the scope of any or all implementations. Its sole purpose is to present some concepts of one or more implementations in a simplified form as a prelude to the more detailed description that is presented later.

According to one feature, a modular living unit is provided. The modular living unit comprises an outer module, an inner module and a synthetic module located between the outer module and the inner module. The outer module may comprise one or more of outer module exterior wall panels joined together forming an interior and an exterior of the outer module; and one or more of outer module interior wall panels located within the interior of the outer module and affixed to the one or more outer module exterior wall panels. The inner module may comprise one or more of inner module exterior wall panels joined forming an interior and an exterior of the inner module; one or more of inner module interior wall panels located within the interior of the inner module and affixed to the one or more inner module exterior wall panels; and a synthetic module located between the outer module and the inner module and formed by the one or more outer module exterior wall panels and the one or more inner module exterior wall panels.

According to one aspect, the modular living unit may further comprise an outer module ceiling panel secured to top surfaces of the one or more outer module exterior wall panels; an inner module ceiling panel secured to top surfaces of the one or more inner module exterior wall panels; and a synthetic ceiling panel secured to the one or more outer module exterior wall panels and the one or more inner module exterior wall panels forming the synthetic module.

According to another aspect, the modular living unit is devoid of redundant floor panels and redundant ceiling panels.

According to yet another aspect, the modular living unit may further comprise at least one synthetic exterior wall panel joining the inner module to the outer module.

According to yet another aspect, each wall panel in one or more outer module exterior wall panels, the one or more outer module interior wall panels, the one or more inner module exterior wall panels and the one or more inner module interior wall panels are made from light gauge steel.

According to yet another aspect, the outer module and the inner module are devoid of redundant side wall panels.

According to yet another aspect, the outer module, the inner module and the synthetic module have a rectangular configuration.

According to yet another aspect, the inner and outer modules are prefabricated; each wall panel in one or more outer module exterior wall panels, the one or more outer module interior wall panels, the one or more inner module exterior wall panels, the one or more inner module interior wall panels, the outer module ceiling panel, the inner module ceiling panel and the synthetic ceiling panel are fabricated during a first stage; and the inner and outer modules are fabricated during a second stage.

According to another feature, a multi-family building structure including multiple parallel modular living units is provided. The multi-family building structure may comprise a first plurality of parallel modular living units, a second plurality of parallel modular living units and a first synthetic corridor module formed between the first inner module of the each living unit in the first plurality of living units and the second inner module in the second plurality of living units. Each living unit in the first plurality of parallel modular living units may comprises a first outer module; a first inner module; and a first synthetic residential module located between the first outer module and the first inner module. Each living unit in the second plurality of parallel modular living units may comprise a second outer module; a second inner module; and a second synthetic residential module between the second outer module and the second inner module; and a first synthetic corridor module formed between the first inner module of the each living unit in the first plurality of living units and the second inner module in the second plurality of living units.

According to one aspect, the first outer module in the each living unit in the first plurality of living units comprises one or more first outer module exterior wall panels joined together forming an interior and an exterior of the first outer module; and one or more first outer module interior wall panels located within the interior of the first outer module and affixed to the one or more first outer module exterior wall panels.

According to another aspect, the first inner module in the each living unit in the first plurality of living units comprises one or more of first inner module exterior wall panels joined forming an interior and an exterior of the first inner module; and one or more of first inner module interior wall panels located within the interior of the first inner module and affixed to the one or more first inner module exterior wall panels.

According to yet another aspect, the second outer module in the each living unit in the second plurality of living units comprises one or more second outer module exterior wall panels joined together forming an interior and an exterior of the second outer module; and one or more second outer module interior wall panels located within the interior of the second outer module and affixed to the one or more second outer module exterior wall panels.

According to yet another aspect, the second inner module in the each living unit in the second plurality of living units comprises one or more of second inner module exterior wall panels joined forming an interior and an exterior of the second inner module; and one or more of second inner module interior wall panels located within the interior of the second inner module and affixed to the one or more second inner module exterior wall panels.

According to another aspect, the first inner module of the each living unit in the first plurality of parallel modular living units and the second inner module in the second plurality of parallel modular living units house utility connections.

According to another aspect, each living unit in the first plurality of parallel module living units further comprises a first outer module ceiling panel secured to top surfaces of the one or more first outer module exterior wall panels; a first inner module ceiling panel secured to top surfaces of the one or more first inner module exterior wall panels; and a first synthetic residential ceiling panel secured to the one or more first outer module exterior wall panels and the one or more first inner module exterior wall panels forming the first synthetic residential module.

According to another aspect, each living unit in the second plurality parallel of modular living units further comprises a second outer module ceiling panel secured to top surfaces of the one or more second outer module exterior wall panels; a second inner module ceiling panel secured to top surfaces of the one or more second inner module exterior wall panels; and a second synthetic residential ceiling panel secured to the one or more second outer module exterior wall panels and the one or more second inner module exterior wall panels forming the second synthetic residential module.

According to another aspect, the parallel modular living units in first plurality of module parallel modular living units and the parallel modular living units in the second plurality of parallel modular living units are located directly across the synthetic corridor module from each other and include load bearing walls mirror each other.

According to another aspect, the multi-family building structure further comprises a third plurality of parallel modular living units stacked on top of the first plurality of parallel modular living units, a fourth plurality of parallel modular living units stacked on top of the second plurality of parallel modular living units. Each living unit in the third plurality of modular living units may comprise a third outer module; a third inner module; and a third synthetic residential module between the third outer module and the third inner module. Each living unit in the fourth plurality of living units may comprise a fourth outer module; a fourth inner module; and a fourth synthetic residential module between the fourth outer module and the fourth inner module; and a second synthetic corridor module formed between the third inner module of the each living unit in the third plurality of parallel modular living units and the fourth inner module in the fourth plurality of parallel modular living units and a second synthetic corridor module formed between the third inner module of the each living unit in the third plurality of living units and the fourth inner module in the fourth plurality of living units.

According to another aspect, the first and second outer modules and the first and second inner modules are devoid of redundant side wall panels.

According to another aspect, wherein the multi-family building structure further comprises a first synthetic residential module side wall panel connected between the first outer module and the first inner module at a first end of the first synthetic module; a second synthetic residential module side wall panel connected between the first outer module and the first inner module as a second opposing end of the first synthetic module; and a first synthetic residential module ceiling panel placed on top of the first synthetic residential panel.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

DETAILED DESCRIPTION

Figure 1:
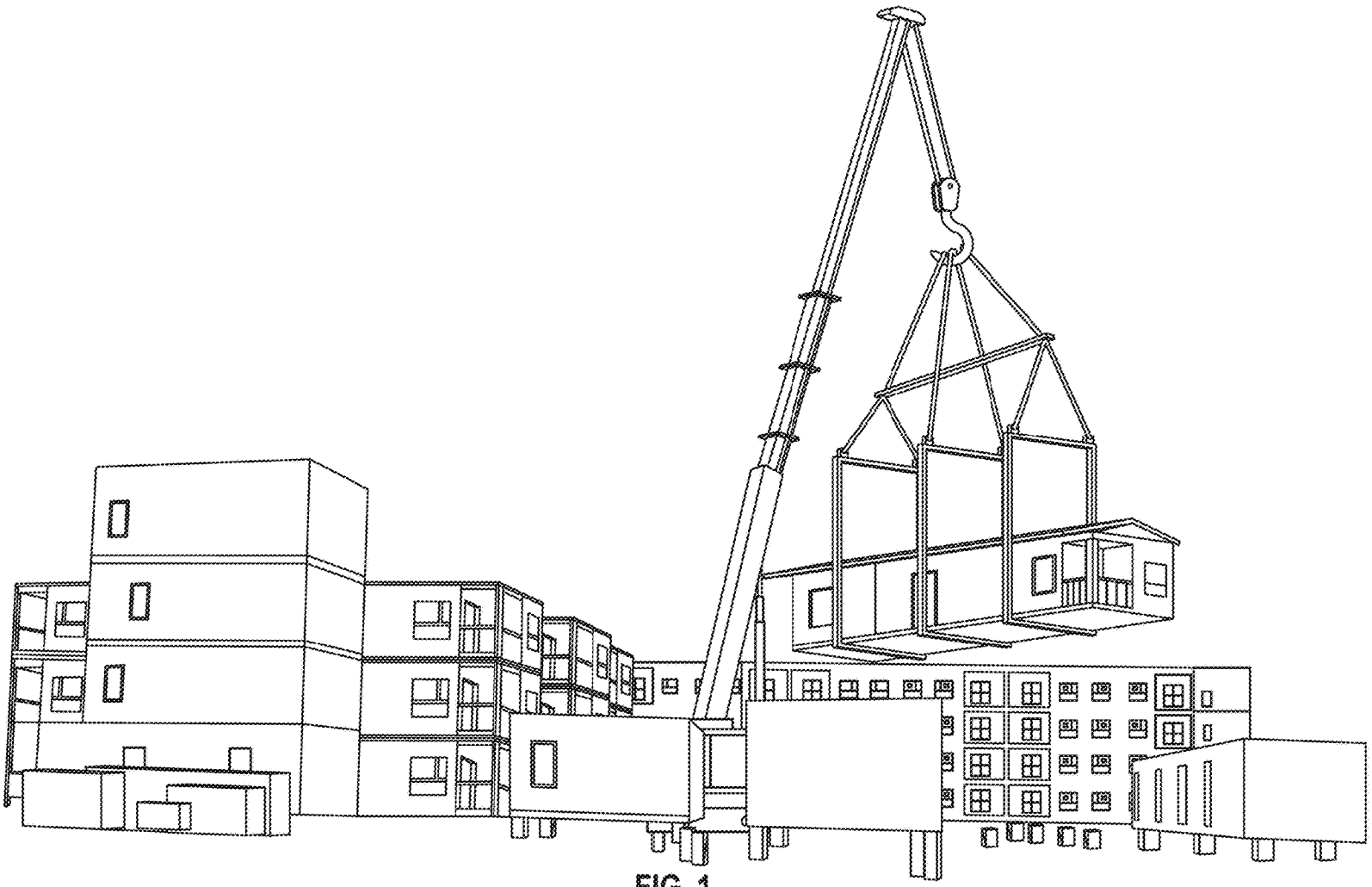
FIG. 1 PRIOR ART
FIG. 1 illustrates an example of modular boxes being stacked one by one atop each other to form a building.
Figure 2:
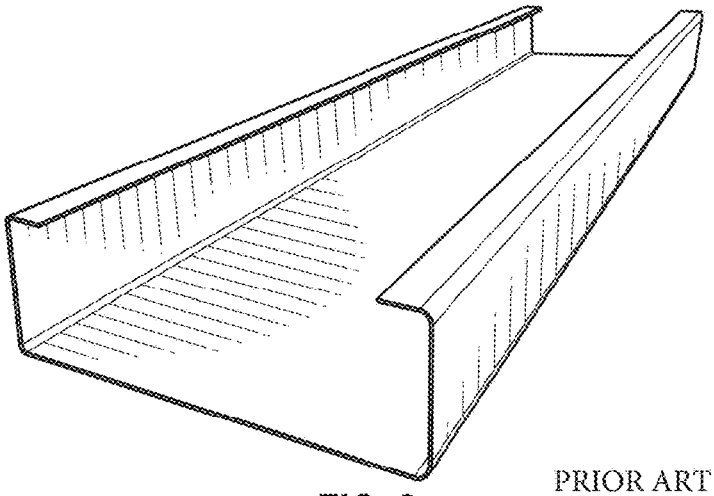
FIG. 2 PRIOR ART
FIG. 2 illustrates an example of a typical metal stud used in construction of buildings.
Figure 3:
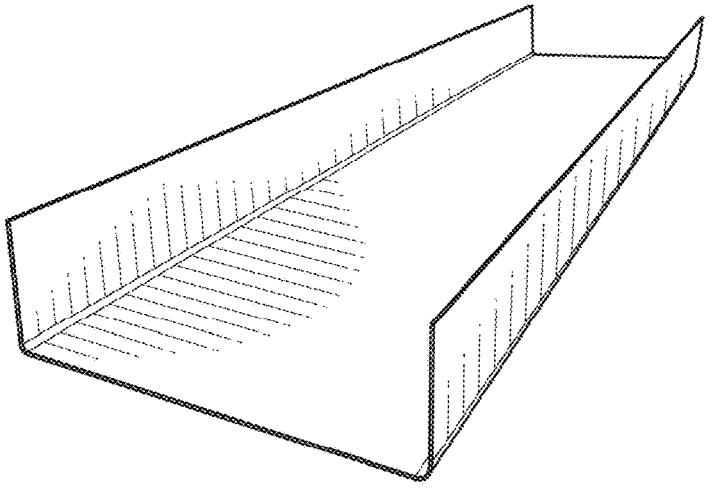
FIG. 3 PRIOR ART
FIG. 3 illustrates an example of a typical metal track used in the construction of buildings.
Figure 4:
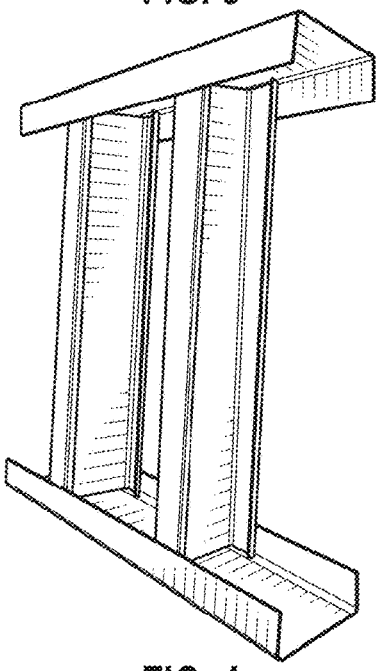
FIG. 4 PRIOR ART
FIG. 4 illustrates an example of connecting metal studs to metal tracks.
Figure 5:
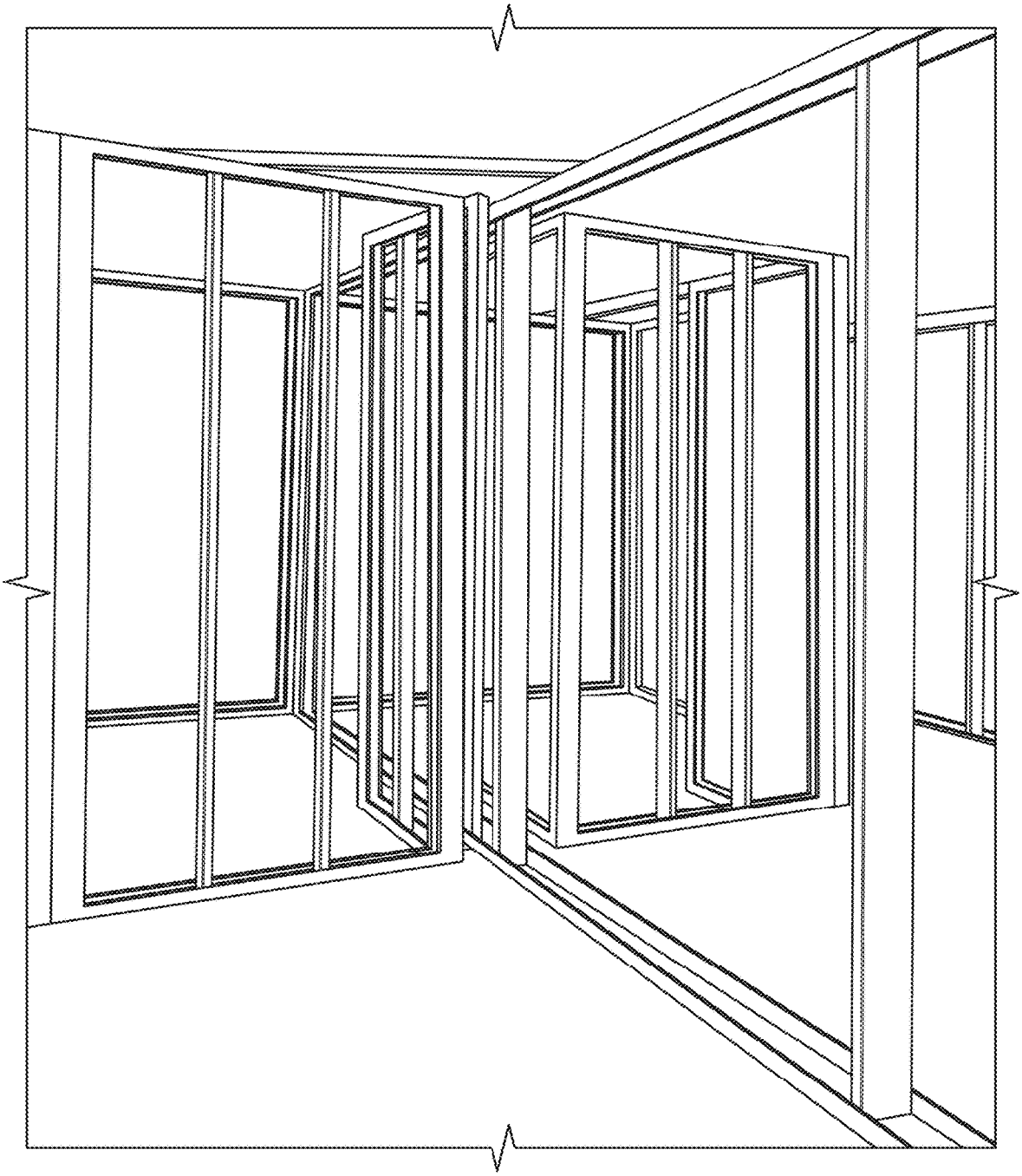
FIG. 5 PRIOR ART
FIG. 5 illustrates a manually built stud wall using a stud and track system.
Figure 6:
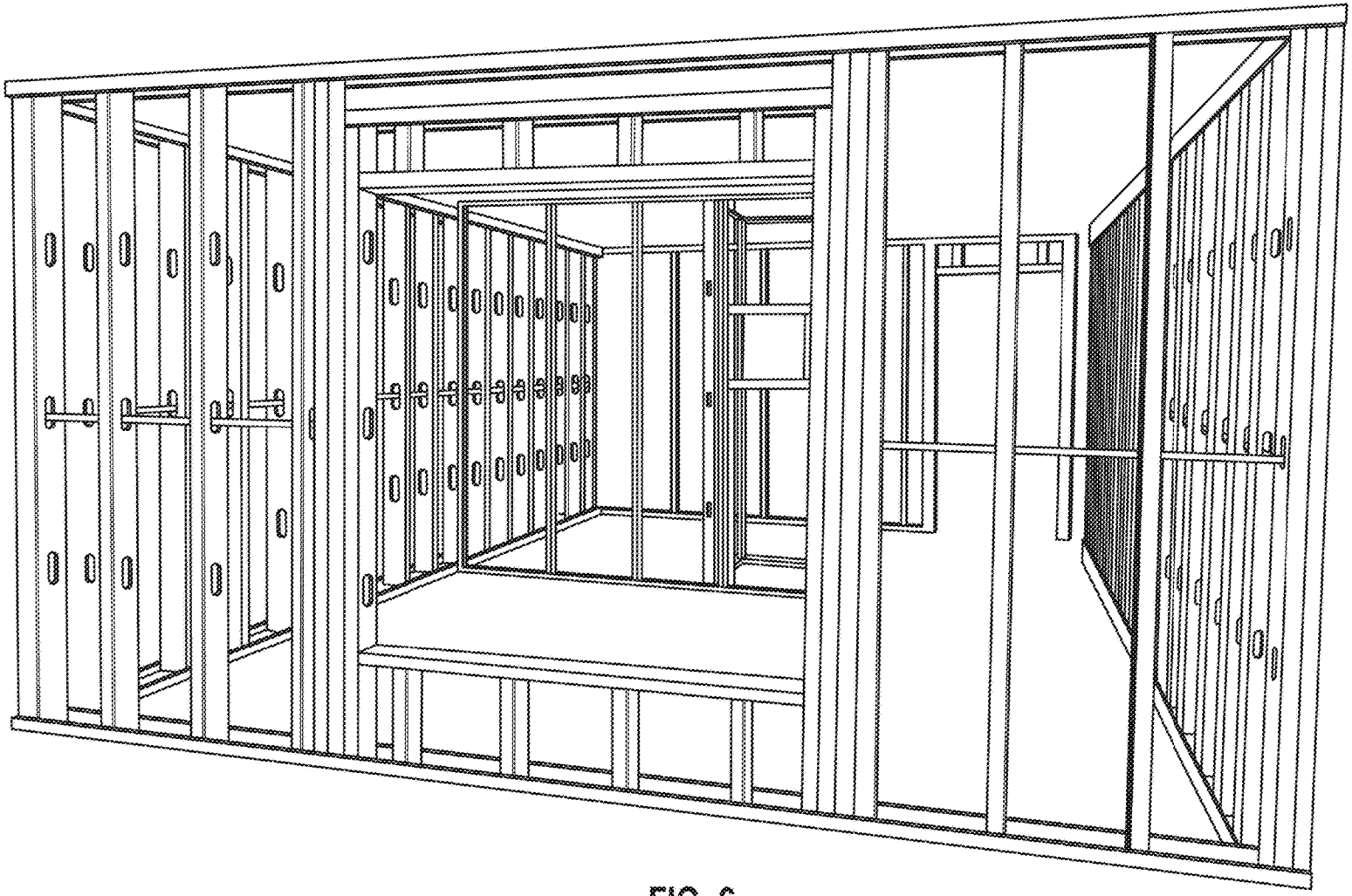
FIG. 6 PRIOR ART
FIG. 6 illustrates multiple stud walls connected together.
Figure 7:
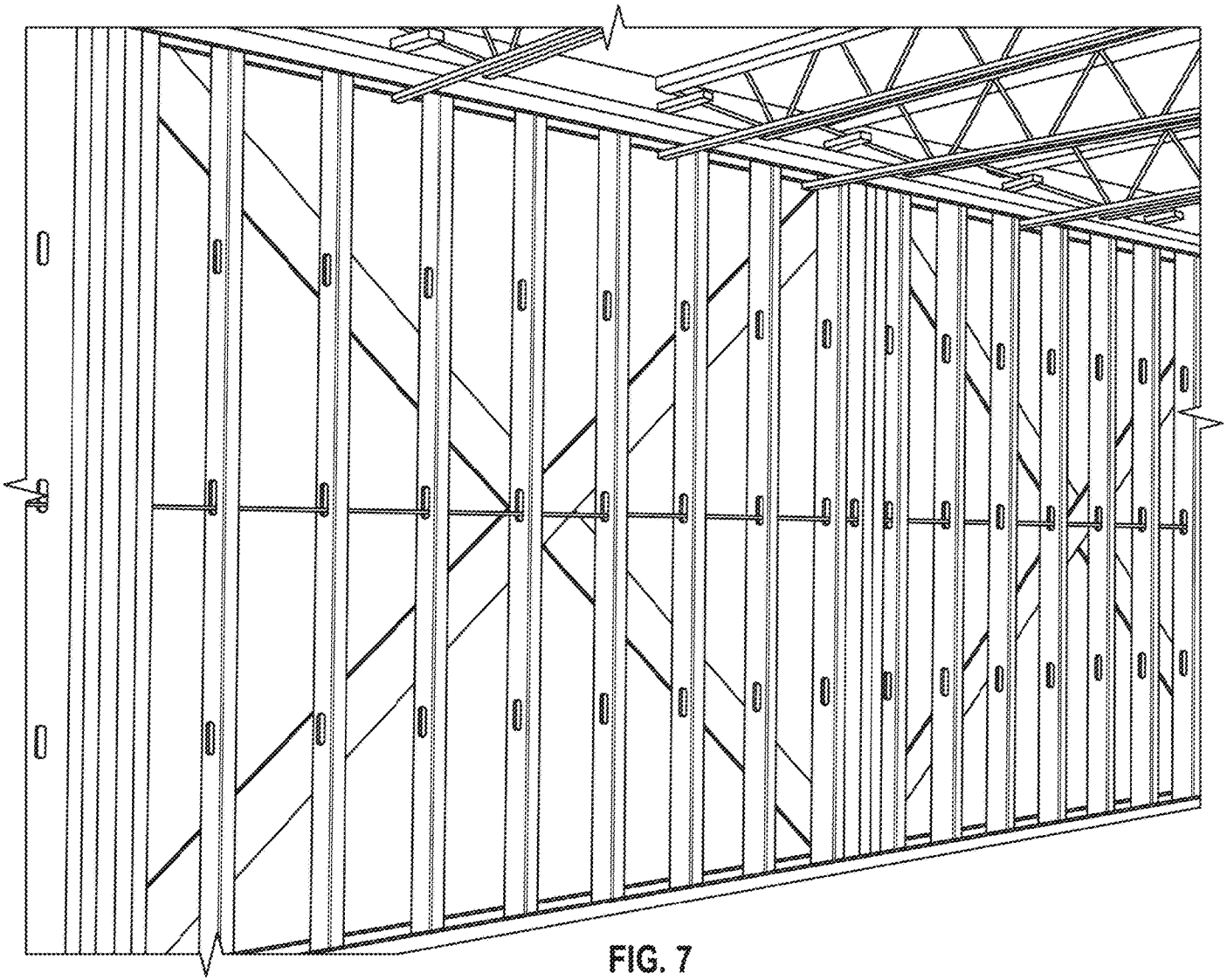
FIG. 7 PRIOR ART
FIG. 7 illustrates an example of stud walls connected to ceiling panels in the construction of a building.

The following detailed description is of the best currently contemplated modes of carrying out the invention. The description is not to be taken in a limiting sense, but is made merely for the purpose of illustrating the general principles of the invention, since the scope of the invention is best defined by the appended claims.

The terms "modular unit", "module" and "box" may be used interchangeably throughout this document. The term "material" may refer to light gauge steel, wood, bricks, stones and other type of building material known in the art to construct a wall. The terms "side wall" may refer to an "exterior wall panel" or an "interior wall panel". The term "synthetic residential module" may refer to the synthetic module formed between the inner module and the outer module. The term "synthetic corridor module" may refer to the synthetic module formed between two inner modules.

It should be noted that the dimensions listed on the drawings are by way of example only and the modules and living units are not limited to the dimensions listed.

Overview of Parallel Module Boxes and Synthetic Parallel Modules for Living Units One feature of the present disclosure is directed to prefabricated parallel modular living units. Each modular living unit may be comprised of a synthetic module located between an inner module and an outer module. According to one example, the outer module, inner module and synthetic module may have generally rectangular or square configurations. The outer module may be comprised of one or more outer module exterior wall panels joined together forming an interior and an exterior of the outer module; and one or more of interior walls panels located within the interior of the outer module and affixed to the one or more outer module exterior wall panels. The inner module an inner module may be comprised of one or more inner module exterior wall panels joined together forming an interior and an exterior of the inner module; and one or more interior wall panels located within the interior of the inner module and affixed to the one or more inner module exterior wall panels. The synthetic module is located between the outer module and the inner module and formed by one or more of the one or more outer module exterior wall panels and one or more of the one or more inner module exterior wall panels.

The outer module may further comprise an outer module ceiling panel secured to top surfaces of the one or more outer module exterior wall panels. The inner module may further comprise an inner ceiling panel secured to top surfaces of the one or more inner module exterior wall panels. The synthetic module may further comprise a synthetic ceiling panel secured to the one or more of the one or more outer module exterior wall panels and the one or more of the one or more inner module exterior wall panels forming the synthetic module.

According to another feature, a multi-family building structure using prefabricated parallel modular living units is provided. The structure comprises at least first plurality of parallel modular living units and a second plurality of parallel modular living units. Each living unit in the first plurality of living units comprises a first outer and inner modules and a first synthetic residential module between the first outer module and the first inner module. Each living unit in the first plurality of living units comprises a second outer and outer modules and a second synthetic residential module between the second outer module and the second inner module. The structure further comprises a synthetic corridor module formed between the first inner module of the each living unit in the first plurality of living units and the second inner module in the second plurality of living units. The outer modules and the inner modules are devoid of redundant side walls.

Three Bedroom Modular Living Unit

Figure 8:
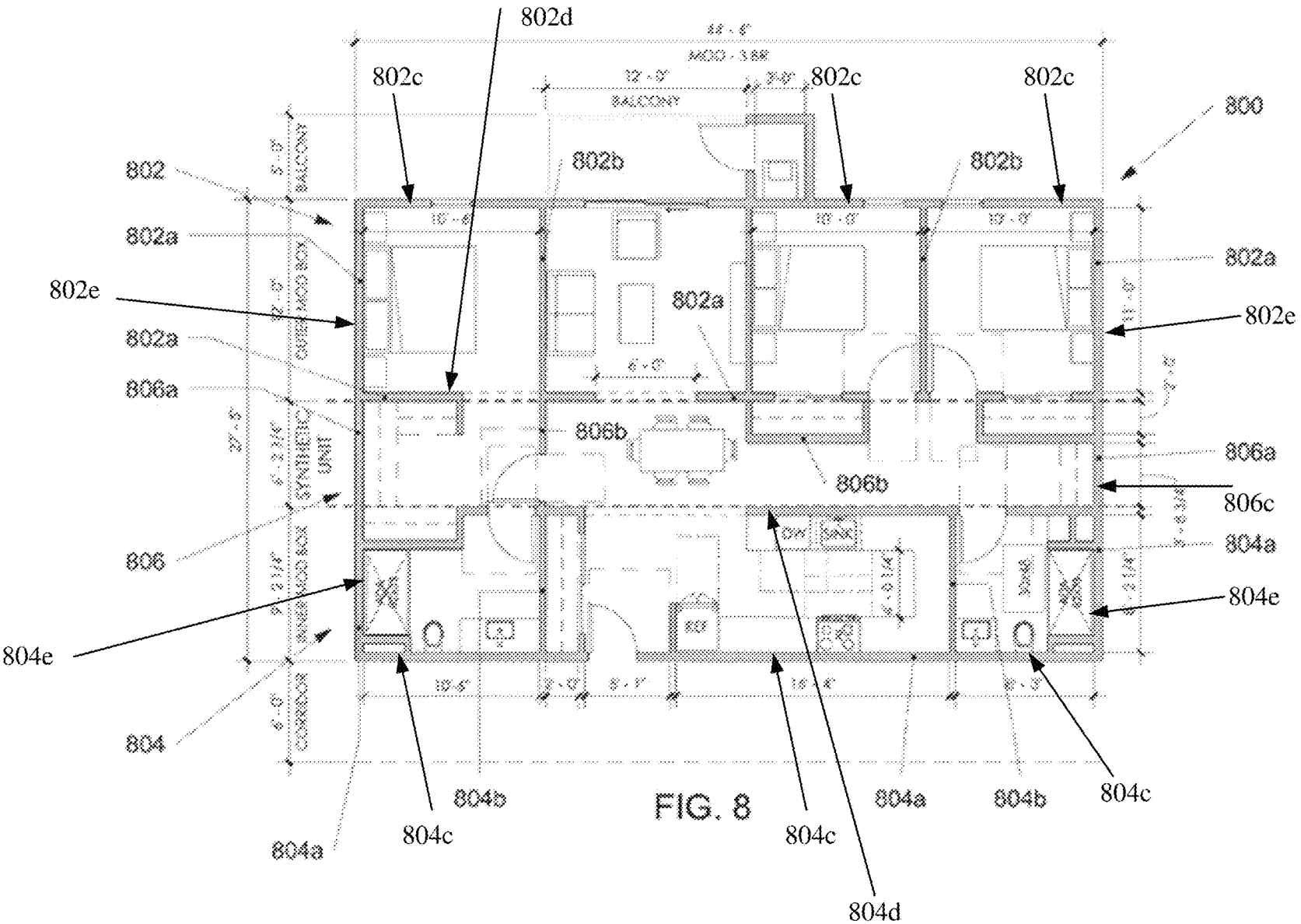
FIG. 8 illustrates an example of a parallel modular living unit having a three (3) bedroom floor plan.

FIG. 8 illustrates an example of a parallel modular living unit 800 having a three (3) bedroom floor plan. The parallel modular living unit 800 may comprise two prefabricated modules (an outer module 802, an inner module 804) and a synthetic module 806 where the synthetic module 806 is located between the outer module 802 and the inner module 804. According to one example, the outer module 802, inner module 804 and synthetic module 806 may have generally rectangular or square configurations.

According to one example, light gauge steel wall panels and ceiling panels may be used for the interior and exterior steel framing for both of the outer and inner modules 802, 804. Both the outer and inner modules 802, 804 may be comprised of interior wall panels and exterior wall panels. To prevent cluttered drawings and enhance readability, not all interior wall panels and exterior wall panels are labeled with a reference numbers in the figures. The exterior wall panels may be used to form the module while the interior wall panels are used to further define rooms or spaces within the modules.

Each of the outer and inner modules 802, 804 may be a five-sided rectangular box (i.e., four side walls with an attached ceiling panel, but no floor). However, as will be described in further detail below, when forming a plurality of modular living units the living units may be placed next to each other such that the living units abut one another. Where living units abut one another, the abutting modules of the living units will have only three side walls or wall panels to eliminate redundancy in the side walls or side panels. The two abutting modules may be installed in a parallel manner set apart from one another.

The outer module 802 may further comprise an outer module ceiling panel secured to top surfaces of the one or more outer module exterior wall panels 802*a* and the one or more outer module interior wall panels 802*b*. The outer module exterior wall panels are joined together forming an outer end wall 802*c*, an opposing inner end wall 802*d*, and a pair of outer sidewalls 802*e*. The inner module 804 may further comprise an inner ceiling panel secured to top surfaces of the one or more inner module exterior wall panels 804*a* and the one or more inner module interior wall panels 804*b*. The inner module exterior wall panels are joined together forming an outer end wall 804*c*, an opposing inner end wall 804*d*, and a pair of outer sidewalls 804*e*. The synthetic module 806 may further comprise a synthetic ceiling panel secured to the one or more of the one or more outer module exterior wall panels 802*a* and the one or more of the one or more inner module exterior wall panels 804*b* forming the synthetic module. The synthetic module 806 may further comprise synthetic module exterior wall panels 806*a*, located between and joining the inner and outer modules 802, 804, and synthetic module interior wall panels 806*b*. The synthetic module is formed by the inner end wall 802*d* of the outer module and the inner end wall 804*d* of the inner module, and a pair of synthetic module side walls 806*c* extending perpendicularly between the inner end wall 802*d* of the outer module and the inner end wall 804*d* of the inner module.

As shown in FIG. 8, the outer module 802, the inner module 804 and the synthetic module 806 may form a living unit having a first bedroom, a second bedroom, a third bedroom, a living room, a dining room, a kitchen, a first bathroom and second bathroom.

Two Bedroom Modular Living Unit

Figure 9:
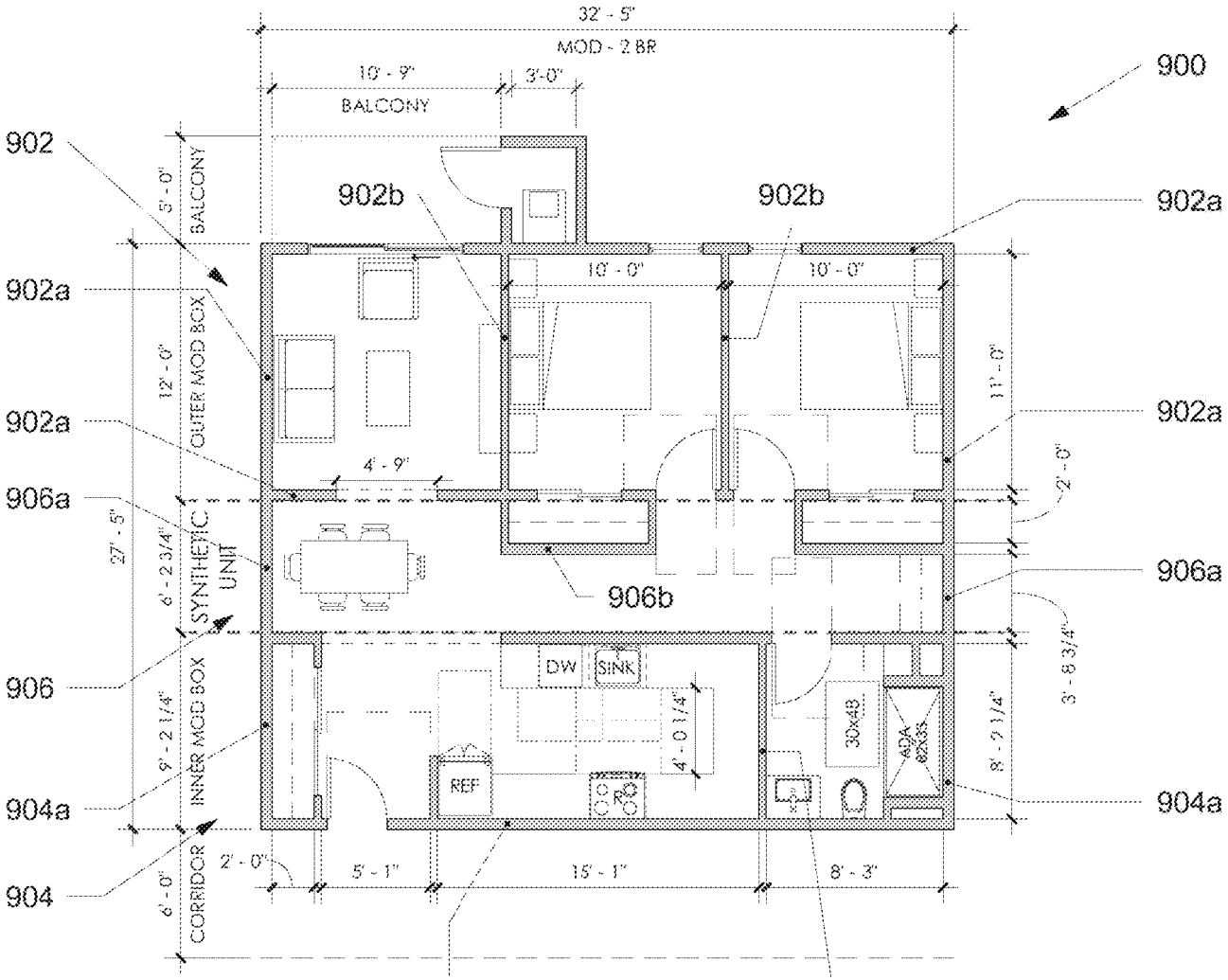
FIG. 9 illustrates an example of a parallel modular living unit having two (2) bedrooms.

FIG. 9 illustrates an example of a parallel modular living unit 900 having two (2) bedrooms. In this example, an outer module 902, an inner module 904 and a synthetic module 906 located between the outer module 902 and the inner module 904 may be used to form a two bedroom modular living unit. According to one example, the outer module 902 and the inner module 904 are pre-fabricated. According to one example, the outer module 902, inner module 904 and synthetic module 906 may have generally rectangular or square configurations.

According to one example, light gauge steel wall panels and ceiling panels may be used for the interior and exterior steel framing for both of the outer and inner modules 902, 904. Both the outer and inner modules 902, 904 may be comprised of interior wall panels and exterior wall panels. To prevent cluttered drawings and enhance readability, not all interior wall panels and exterior wall panels are labeled with a reference numbers in the figures. The exterior wall panels may be used to form the module while the interior wall panels are used to further define rooms or spaces within the modules.

Each of the outer and inner modules 902, 904 may be a five-sided rectangular box (i.e., four side walls with an attached ceiling panel, but no floor). However, as will be described in further detail below, when forming a plurality of modular living units the living units may be placed next to each other such that the living units abut one another. Where living units abut one another, the abutting modules of the living units will have only three side walls or wall panels to eliminate redundancy in the side walls or side panels. The two abutting modules may be installed in a parallel manner set apart from one another.

The outer module 902 may further comprise an outer module ceiling panel secured to top surfaces of the one or more outer module exterior wall panels 902*a* and the one or more outer module interior wall panels 902*b*. The inner module 904 may further comprise an inner ceiling panel secured to top surfaces of the one or more inner module exterior wall panels 904*a* and the one or more inner module interior wall panels 904*b*. The synthetic module 906 may further comprise a synthetic ceiling panel secured to the one or more outer module exterior wall panels 902*a* and the one or more of inner module exterior wall panels 904*b* forming the synthetic module. The synthetic module 906 may further comprise synthetic module exterior wall panels 906*a*, located between and joining the inner and outer modules 902, 904, and synthetic module interior wall panels 906*b*.

As shown in FIG. 9, the outer module 902, the inner module 904 and the synthetic module 906 may form a living unit having a first bedroom, a second bedroom, a living room, a dining room, a kitchen and a bathroom.

One Bedroom With Studio Modular Living Unit

Figure 10:
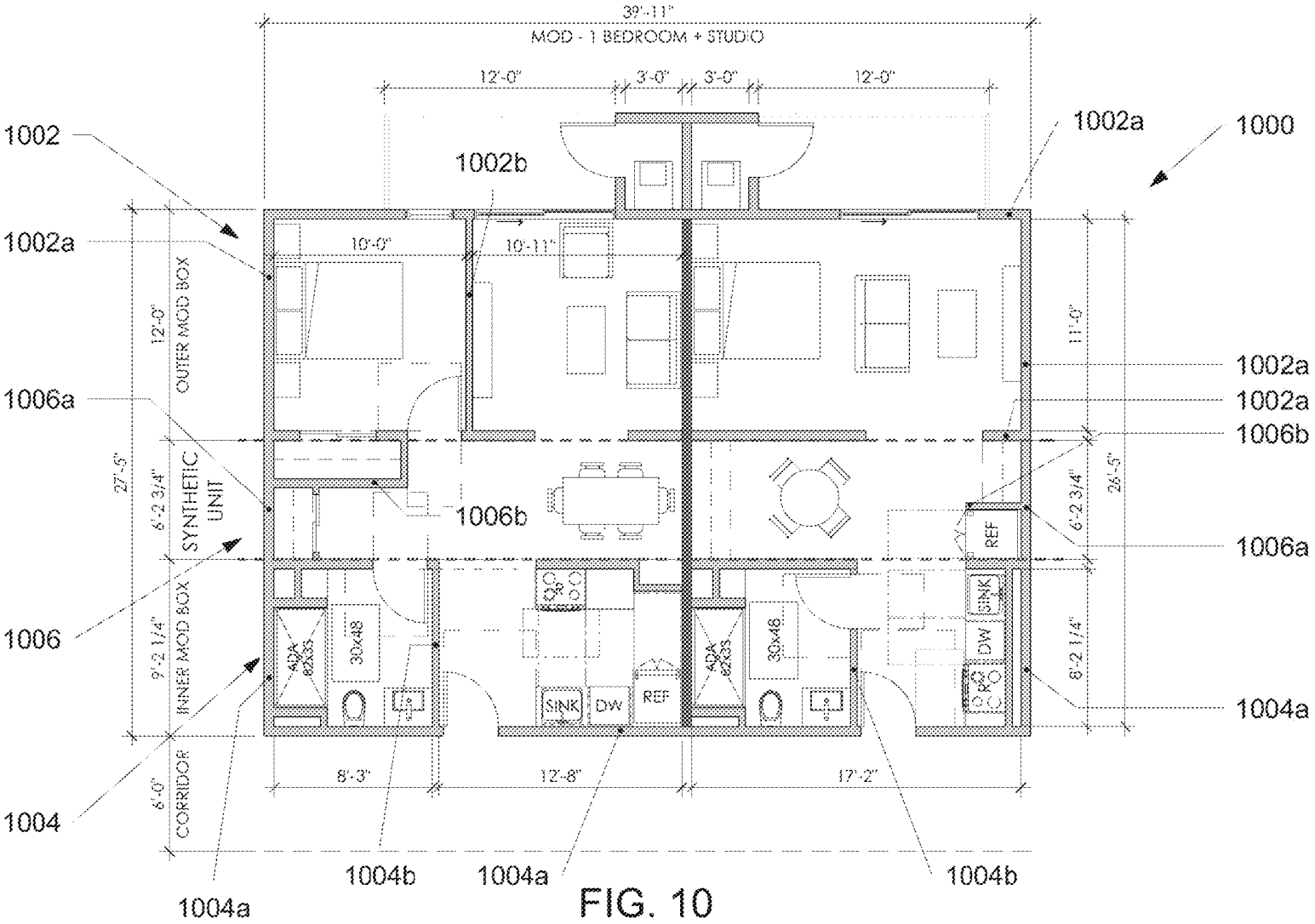
FIG. 10 illustrates an example of parallel modular living unit having a single bedroom and studio floor plan.

FIG. 10 illustrates an example of parallel modular living unit 1000 having a single bedroom and studio floor plan. In this example, an outer module 1002, an inner module 1004 and a synthetic module 1006 located between the outer module 1002 and the inner module 1004 may be used to form a single bedroom and studio floor plan modular living unit. According to one example, the outer module 1002 and the inner module 1004 are pre-fabricated. According to one example, the outer module 1002, inner module 1004 and synthetic module 1006 may have generally rectangular or square configurations.

According to one example, light gauge steel wall panels and ceiling panels may be used for the interior and exterior steel framing for both of the outer and inner modules 1002, 1004. Both the outer and inner modules 1002, 1004 may be comprised of interior wall panels and exterior wall panels. To prevent cluttered drawings and enhance readability, not all interior wall panels and exterior wall panels are labeled with a reference numbers in the figures. The exterior wall panels may be used to form the module while the interior wall panels are used to further define rooms or spaces within the modules.

Each of the outer and inner modules 1002, 1004 may be a five-sided rectangular box (i.e., four side walls with an attached ceiling panel, but no floor). However, as will be described in further detail below, when forming a plurality of modular living units the living units may be placed next to each other such that the living units abut one another. Where living units abut one another, the abutting modules of the living units will have only three side walls or wall panels to eliminate redundancy in the side walls or side panels. The two abutting modules may be installed in a parallel manner set apart from one another.

The outer module 1002 may further comprise an outer module ceiling panel secured to top surfaces of the one or more outer module exterior wall panels 1002*a* and the one or more outer module interior wall panels 1002*b*. The inner module 1004 may further comprise an inner ceiling panel secured to top surfaces of the one or more inner module exterior wall panels 1004*a* and the one or more inner module interior wall panels 1004*b*. The synthetic module 1006 may further comprise a synthetic ceiling panel secured to the one or more outer module exterior wall panels 1002*a* and the one or more inner module exterior wall panels 1004*b* forming the synthetic module. The synthetic module 1006 may further comprise synthetic module exterior wall panels 1006*a*, located between and joining the inner and outer modules 1002, 1004, and synthetic module interior wall panels 1006*b*.

As shown in FIG. 10, a synthetic interior wall panel 1006*b* may be located between the outer module 1002 and the inner module 1004 in the synthetic module 1006 to form two separate living spaces (a one bedroom apartment and a studio apartment) in a single living unit. By use of the synthetic interior wall panel 1006*b*, the outer module 1002, the inner module 1004 and the synthetic module 1006 may form (1) a first living area having a bedroom, a living room, a dining room, a kitchen and a bathroom, and (2) a second living area having a combined living room/bedroom found in studio apartments, a dining area, a kitchen and a bathroom.

Example Floor Plan Using Multiple Parallel Modular Units

Figure 11:
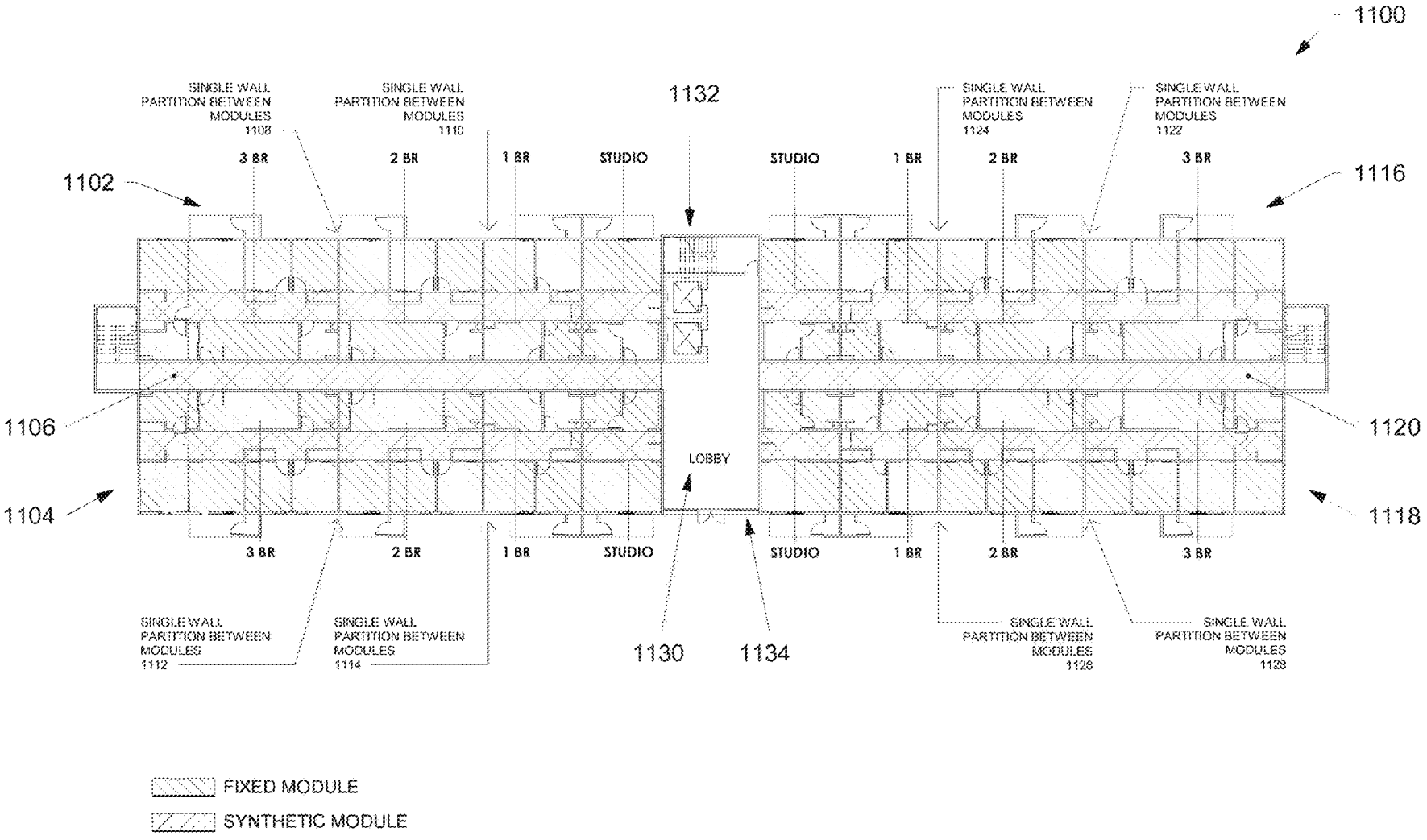
FIG. 11 illustrates an example of a floor plan formed by connecting multiple parallel modular living units together.

FIG. 11 illustrates an example of a floor plan 1100 formed by connecting multiple parallel modular living units together. In this example, the floor plan comprises the use of three (3) bedroom living units, two (2) bedroom living units and combined single bedroom apartment and studio apartment living units. Each of these living units may be structured as described above with reference to FIGS. 8-10.

As shown, a first plurality of living units may be connected in parallel to each other, as described in more detail below, a second plurality of living units, also connected in parallel to each other may be separated by a distance between the inner modules of the first plurality of living units 1102 and the outer modules of the second plurality of living units 1104 forming a corridor 1106 in the form of a synthetic module. The first plurality of parallel living units 1102 may comprise a three (3) bedroom living units abutting a two (2) bedroom living unit, on a first side, and separated by a single wall partition 1108, and a combined single bedroom apartment and studio apartment living unit abutting the two (2) bedroom living unit, on a second opposing side, and separated by a single wall partition 1110. The second plurality of parallel living units 1104 may also comprise a three (3) bedroom living units abutting a two (2) bedroom living unit, on a first side, and separated by a single wall partition 1112, and a combined single bedroom apartment and studio apartment living unit abutting the two (2) bedroom living unit, on a second opposing side, and separated by a single wall partition 1114.

The floor plan 1100 of FIG. 11 also includes a third of parallel living units 1116 and a fourth of parallel living units 1118 separated by a distance between the inner modules of the third plurality of living units 1116 and the outer modules of the fourth plurality of living units 1118 forming a second corridor 1120 in the form of a synthetic module. The third plurality of parallel living units 1116 may also comprise a three (3) bedroom living units abutting a two (2) bedroom living unit, on a first side, and separated by a single wall partition 1122, and a combined single bedroom apartment and studio apartment living unit abutting the two (2) bedroom living unit, on a second opposing side, and separated by a single wall partition 1124. The fourth plurality of parallel living units 1104 may also comprise a three (3) bedroom living units abutting a two (2) bedroom living unit, on a first side, and separated by a single wall partition 1126, and a combined single bedroom apartment and studio apartment living unit abutting the two (2) bedroom living unit, on a second opposing side, and separated by a single wall partition 1128.

A lobby 1130 may be located between the first and second plurality of living units 1102, 1104 and the third and fourth plurality of living units 1116, 1118. A first outer module exterior wall panel 1132 may be utilized to connect the first and third plurality of living units 1102, 1116 and a second outer module exterior wall panel 1134 may be utilized to connect the second and fourth plurality of living units 1104, 1118 forming the lobby 1130.

In order to provide both the structural integrity and economic feasibility for lower cost living units, this example floor plan requires that both the first plurality of parallel living units 1102 and the second plurality of parallel living units 1116 abutting the corridor 1106 be of the same bedroom type (i.e., a 3 bedroom living unit will be directly across the corridor from a 3 bedroom living unit, and a 2 bedroom unit will be directly across the corridor from another 2 bedroom unit, etc.). Similarly, the third plurality of living units 1116 and the fourth plurality of parallel living units 1118 abutting the corridor 1120 be of the same bedroom type (i.e., a 3 bedroom living unit will be directly across the corridor from a 3 bedroom living unit, and a 2 bedroom unit will be directly across the corridor from another 2 bedroom unit, etc.).

As described in detail above, a living unit may comprise two prefabricated modules (an inner module and an outer module) and one synthetic module. Light gauge steel wall panels and ceiling panels may be used for the interior and exterior steel framing for both of the interior and outer modules. Light gauge steel is by way of example only and the wall panels and ceiling panels may be constructed from any type of material known in the art to construct wall and ceiling panels. The inner and outer modules may be a five-sided rectangular box (i.e., four side walls with an attached ceiling panel, but no floor). However, where living units abut one another, the abutting modules in the living units may have only three side wall panels to eliminate redundancy in the side wall panels. The living unit may be installed in a parallel manner set apart from one another. According to one example, the living units illustrated in FIGS. 8-10 may utilize a distance of approximately six feet between the inner and outer modules. The distance of six feet is by way of example only and the distance may be less than 6 feet or greater than 6 feet.

Figure 12:
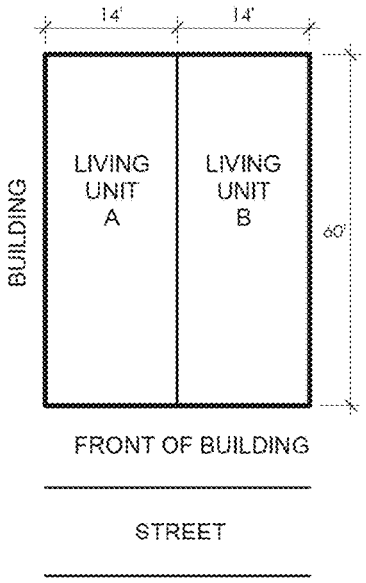
FIG. 12 illustrates an example of a conventional structure of two module living units connected together perpendicularly.
Figure 13:
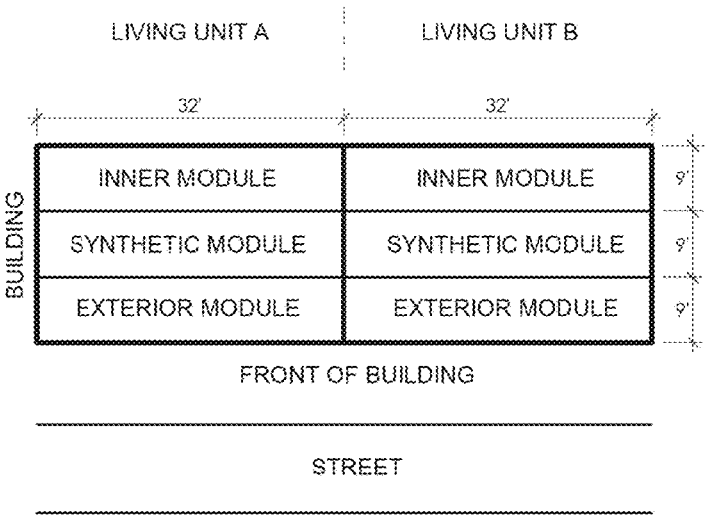
FIG. 13 illustrates an example of module living units utilizing synthetic modules connected in parallel according to one aspect of the present disclosure.

Installing these two living units in a parallel manner means that the long side of all modules will run in the same direction as the exterior of the building. A simple diagram distinguishing between a module set in a parallel manner and one set in a perpendicular manner is set forth in FIGS. 12-13. FIG. 12 illustrates an example of a conventional structure of two module living units connected together perpendicularly. FIG. 13 illustrates an example of module living units utilizing synthetic modules connected in parallel according to one aspect of the present disclosure.

Installation Process of Parallel Module Living Units

Figures 14A, 14B, 14C:
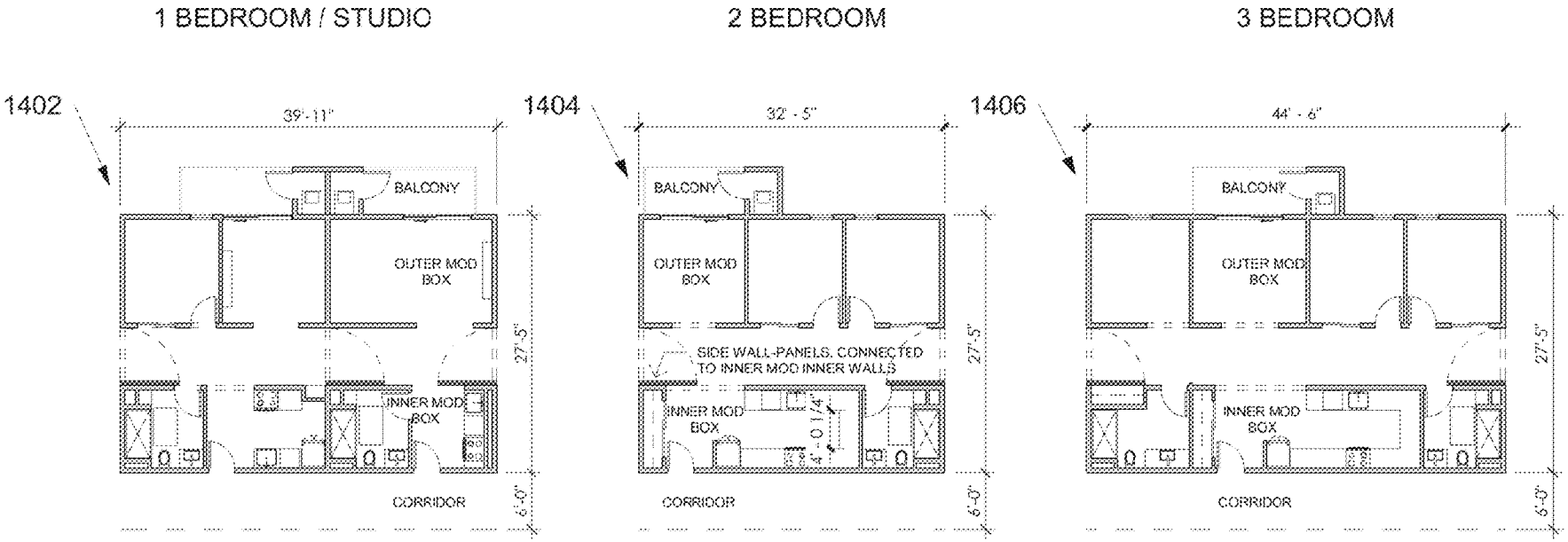
FIGS. 14A, 14B and 14C illustrate inner and outer modules to be used in the construction of parallel modular living units.

The first step in the process of installing or constructing parallel module living units is the prefabrication and assembly of the inner modules and the outer modules. FIGS. 14A, 14B and 14C illustrate inner and outer modules to be used in the construction of parallel modular living units. In this example, the parallel module living units may comprise a combined single bedroom apartment and studio apartment living unit 1402, a two (2) bedroom living unit 1404 and a three (3) bedroom living unit 1406.

When constructing the parallel module living units, the first modules to be installed are the inner modules which may also be referred to as the interior service modules as the inner modules contains all the electrical and plumbing line connections for the bathrooms and kitchens of the living units. Next, the outer module is installed (or set in place). The outer module may also be referred to as the outer, non-serviced module. The bedrooms of the living units will be located in the outer modules which may include windows to the outside. According to one example, when installed, the distance between the inner module and outer module may be between five to twelve feet. This distance is by way of example and the distance may be less than five feet or greater than twelve feet. FIGS. 8-10 illustrate plans that reflect a distance of approximately six feet for the open space between the outer module and the inner module.

Figures 15A, 15B, 15C:
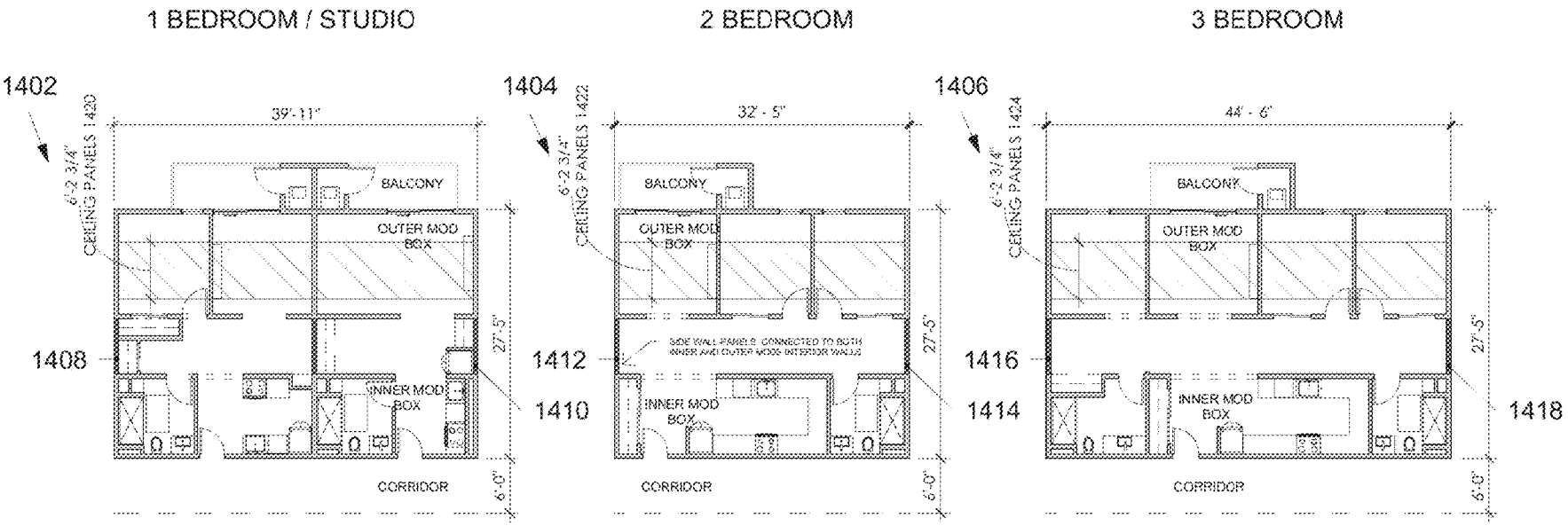
FIGS. 15A, 15B and 15C illustrate the closing of the synthetic residential modules side wall panels between inner and outer modules.

The distance between the outer and inner modules creates an open space area that will already by bordered by side wall panels of the inner module and the outer module. Two wall panels, one for each end of the open space, may be installed (i.e. connected to both the inner and outer modules interior wall panels) followed by a ceiling panel on top of the open space transforming the open space into a into a five-sided rectangular box in between the inner module and the outer module and forming the synthetic module which is described in detail above. Accordingly, one residential living unit may be comprised of the two prefabricated modules (the inner module and the outer module) and the synthetic module. The two wall panels (1408-1418) and the ceiling panels 1420-1424 for each living unit 1402-1406 are illustrated in FIGS. 15A, 15B and 15C. FIGS. 15A, 15B and 15C illustrate the closing of the synthetic residential modules side wall panels between inner and outer modules.

Figures 16A, 16B, 16C:
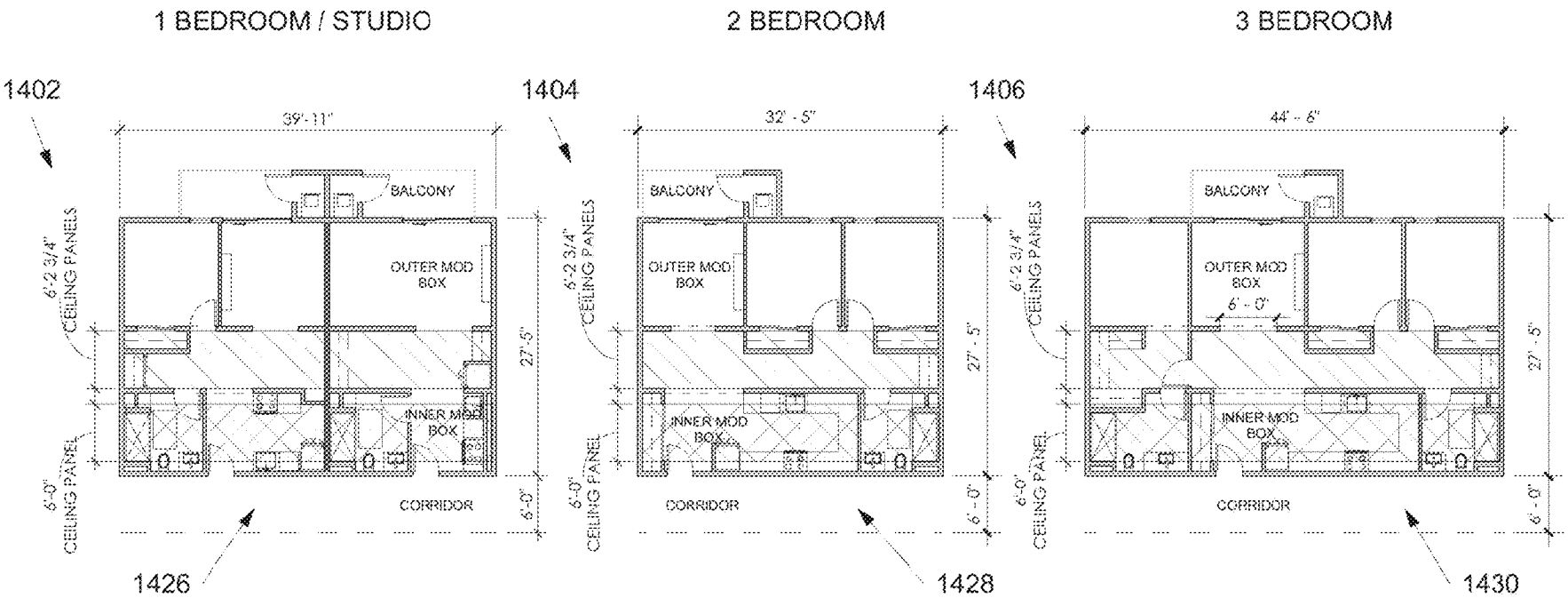
FIGS. 16A, 16B, and 16C illustrate placing the synthetic residential module ceiling panels between the inner and outer modules.
Figures 17A, 17B, 17C:
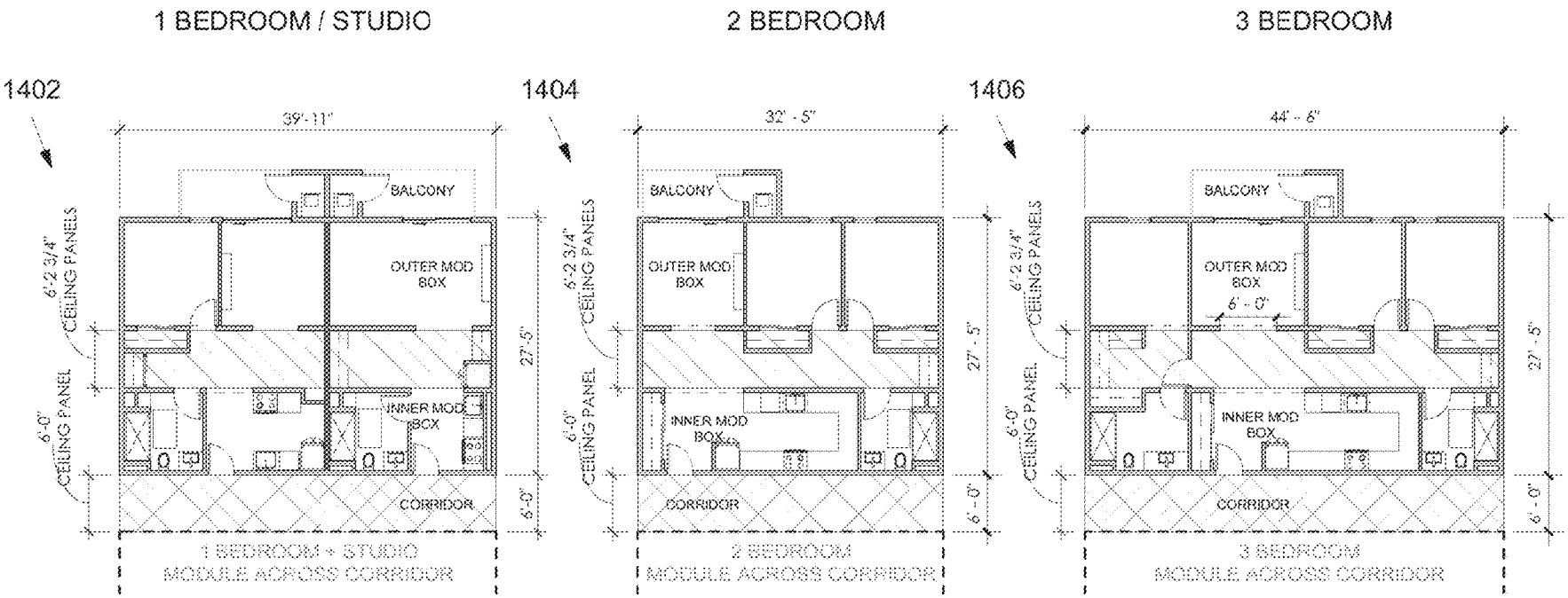
FIGS. 17A, 17B and 17C illustrate completed synthetic corridor modules of the parallel living units after the placement of the ceiling panels between the two inner modules for form the synthetic corridor module.

For building efficiency reasons, most multifamily structures utilize a double loaded corridor 1426-1430 (i.e., an apartment or condominium floor plan where a central corridor serves living units on each side of the corridor). When constructing a building with a floor plan as shown in FIG. 11, the two inner modules in the floor plan may be stacked and placed approximately 6 to 8 feet apart from one another. This distance is by way of example only and the distance may be less than 6 feet or greater than 8 feet. However, instead of dropping an actual module in this space, the open corridor area will simply have a 6 foot wide ceiling panel (for example, depending on the distance between the two inner modules) connected to the upper corners of the two inner modules creating yet another synthetic module or a synthetic corridor module, for example corridors 1426-1430 of living units 1402-1406, respectively. Finally, a balcony may be structurally attached to the exterior wall of the outer module. In one example, the balcony may be 5×8 foot but other dimensions are possible. FIGS. 16A, 16B, and 16C illustrate placing the synthetic residential module ceiling panels between the inner and outer modules. FIGS. 17A, 17B and 17C illustrate completed synthetic corridor modules of the parallel living units after the placement of the ceiling panels between the two inner modules for form the synthetic corridor module.

The living units may be prefabricated and assembled in two stages. The first stage includes the production and assembly of the precisely formed wall panels and ceiling panels at a wall panel facility, for example. The production may take place at any location available to the manufacturer. Completed wall panels and ceiling panels may then be loaded onto a trailer. In one example, such a load of completed wall panels and ceiling panels could carry up to 800 linear feet of panels per load and a fully loaded trailer would weigh considerably less than a conventional six sided perpendicular module.

Next, during the second stage, the wall panels and the ceiling panels may be off loaded at a modular assembly factory, for example, in such a manner that the required three or four wall panels for a module will be joined together into a three or four sided rectangular box. The assembly may take place at any location available to the manufacturer. After joining the three or four panels together, the ceiling panel may be installed onto the three or four sided rectangular module creating a four or five sided actual module. Both the inner and outer modules may then have all interior wall partitions affixed to the structural frames of their module and the inner modules may then be fitted up with all the plumbing and service connections for the kitchen and bathrooms at the same location, such as a modular assembly factory. In addition, the HVAC duct system, the electrical conduits and actual wiring for the living unit and such other cladding and interior system finishing as is cost effective may also be installed in the actual modules at this time before the modules are transported to the jobsite. The assembly site may be within 30 miles of the jobsite (i.e., site of development building), for example.

Once construction of the inner modules and the outer modules is completed, the inner and outer modules are ready for transportation to the jobsite for hoisting and stacking. Since the actual outer module should weigh less than 5,000 pounds and since the inner module should weigh less than 10,000 pounds, a heavy duty pickup with the ability to haul in excess of 20,000 pounds may be utilized to transport the completed modules from assembly site. If, however, the completed module is in excess of 44 feet long a single drop deck 60 foot trailer, for example, may be used to transport the module to the job site.

Finally, once at the jobsite the hoisting and stacking of a 5,000 pound or 10,000 pound module (as contrasted with a conventional 35,000 pound module) will proceed with few if any weight related issues that accompany the heavy conventional modules. Once the inner and outer modules are stacked in the building, the framing on the two synthetic modules (i.e., the synthetic residential module and the synthetic corridor module) should require little time and effort, while at the same time eliminating the double wall redundancy of conventional modular construction.

The inner modules, outer modules and synthetic modules may be stacked on a floor-by-floor basis reaching 2 floors to 9 floors in height (with increased height the gauges of the cold formed steel in the lower floor load bearing walls will be increased as required to account for the increased vertical load of the structure). Stacking the modules to reach between 2 floors to 9 floors is by way of example only and the parallel modular living units may be a single floor or may be greater than 9 floors.

Both the inner and outer modules and the synthetic modules may contain a ceiling joist running perpendicular to the parallel modules and the joists (part of the ceiling panels) on 24 inch centers, for example, may be covered by sheets of corrugated metal decking. That metal decking (which will ultimately be filled with light weight concrete at the conclusion of the development of the structure) will serve as the floor of the identical module units which will be stacked on a floor by floor basis over one completed floor plate of modular units. When the structure has reached its ultimate height, concrete will be poured into the metal decking on the highest floor [first] and then the same day poured into the metal decking on the next lower floor.

By pouring concrete from the top floor down when all the modules have been set in place, the construction of the structure can proceed rapidly on a wall over wall basis without pouring concrete (and letting it cure) one floor at a time.

Figure 18:
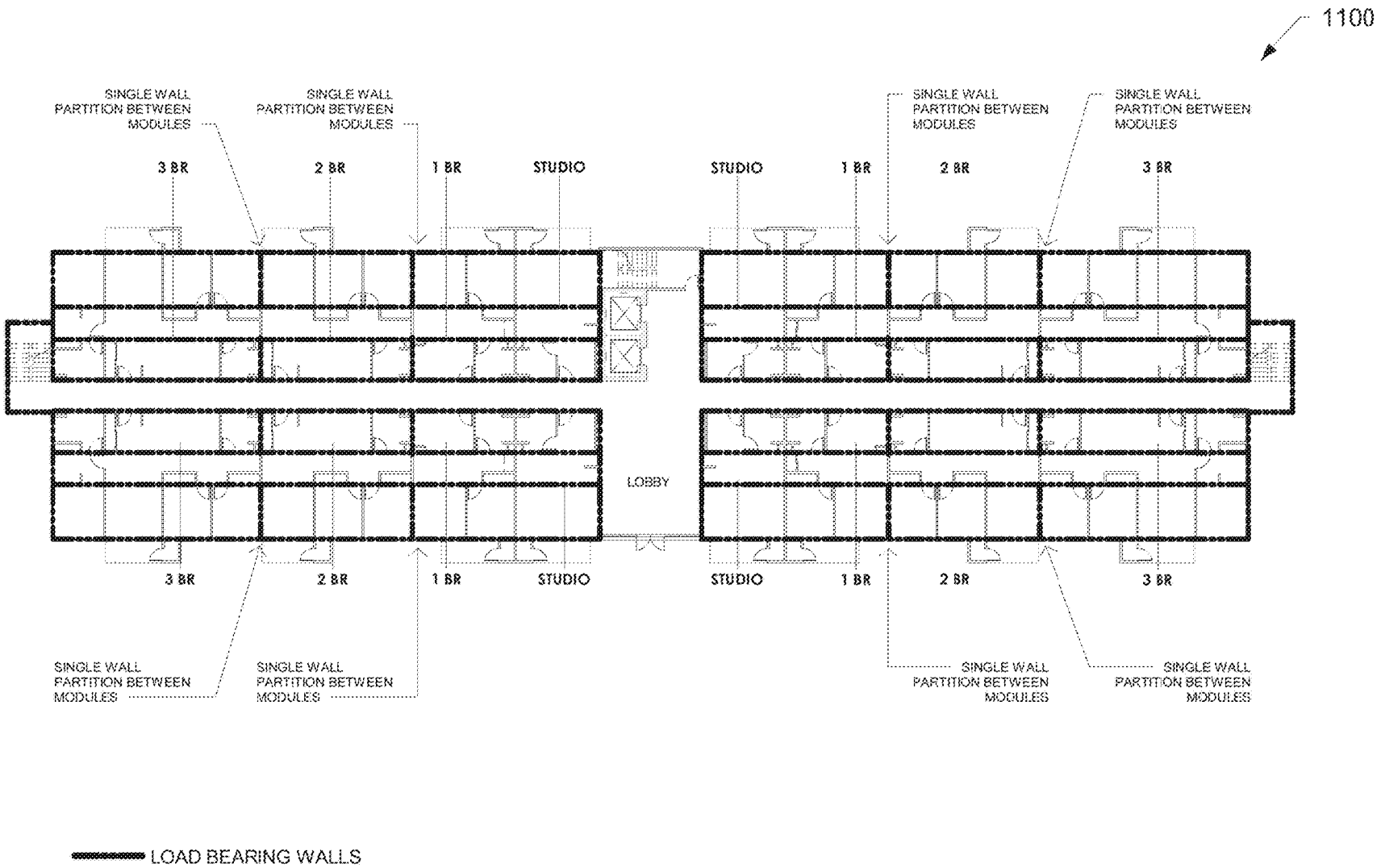
FIG. 18 illustrates the load bearing walls of the floor plan of FIG. 11.
Figure 19:
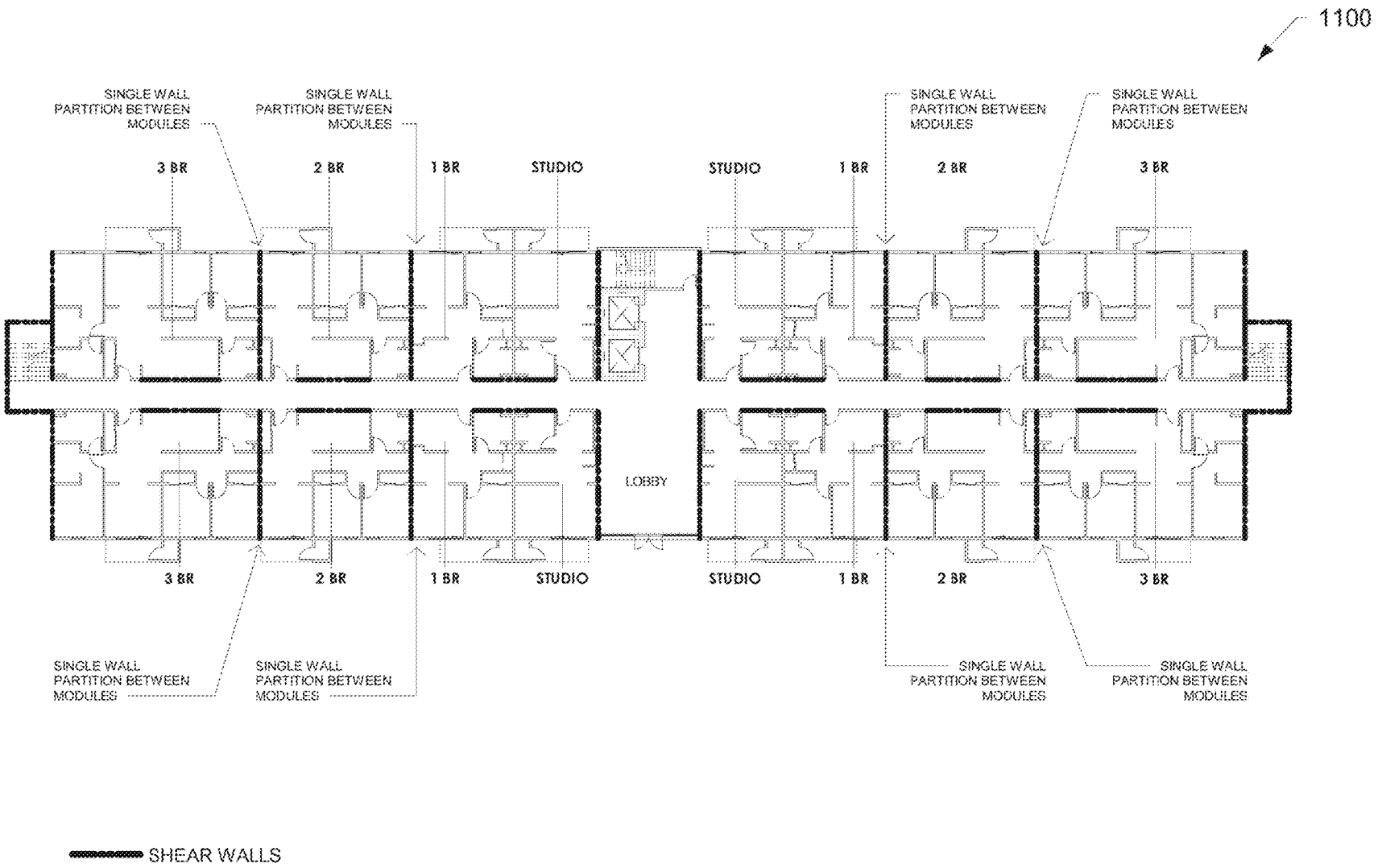
FIG. 19 illustrates the shear walls of the floor plan of FIG. 11.

Light gauge steel modular housing is not yet conventional in part because of perceived structural issues with such developments. The novel floor plan design described above has sufficient load bearing walls which satisfy the required vertical loads of the structure see FIG. 18). It should be noted that the wall panels for each of the inner modules and outer modules may be a light gauge metal load bearing wall. Modular living units that are located across from each other and are separated by the synthetic corridor module include load bearing walls which mirror each other. In addition, FIG. 19 reflects which portions of the floor plan may comprise of shear walls of the appropriate required resistance to satisfy the prevailing wind and seismic loads.

Advantages of the present disclosure may include (1) light gauge steel parallel modular living units with no redundant side walls, i.e. the inner and outer modules are devoid of redundant side walls; (2) light gauge steel parallel modular living units with no redundant floor/ceiling panels; (3) light gauge steel parallel modular living units which incorporate a serviced inner module adjacent to a corridor which module will house kitchens and bathrooms and provide utility connections therefore; (4) light gauge steel parallel modular living units which incorporate a separate inner module, outer module and a synthetic module in between the inner module and outer module; (5) light gauge steel parallel modular living units which utilize a modular stacking process whereby all concrete floors are poured only after the highest floor modules are in place with continuous pouring from the highest floor to the ground floor; (6) a floor plan for light gauge steel parallel modular living units which utilize a synthetic corridor concept between two living units; and (7) a floor plan for parallel modular living units which provides that living units with the same number of bedrooms are arranged across the double loaded corridor from one another in a multi-family building structure that includes multiple parallel modular living units.

One or more of the components and functions illustrated in the previous figures may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this disclosure is not be limited to the specific constructions and arrangements shown and described, since various other modifications may occur to those ordinarily skilled in the art.

The invention claimed is:

1. A light weight parallel modular living unit, comprising:

A. an outer module, the outer module comprising:

(i) one or more outer module exterior wall panels joined together forming an outer end wall, an opposing inner end wall, and a pair of outer sidewalls of the outer module; and (ii) one or more outer module interior wall panels located within the interior of the outer module and affixed to the outer end wall and/or the inner end wall; and B. an inner module, the inner module comprising:

(i) one or more inner module exterior wall panels joined forming an outer end wall, an opposing inner end wall, and a pair of outer side walls of the inner module; and (ii) one or more inner module interior wall panels located within the interior of the inner module and affixed to the outer end wall and/or the inner end wall; and C. a synthetic module located between the outer module and the inner module and formed by the inner end wall of the outer module and the inner end wall of the inner module, and a pair of synthetic module side walls extending perpendicularly between the inner end wall of the outer module and the inner end wall of the inner module; and D. a corridor partially formed by, and parallel relative to, the outer end wall of the inner module; and E. wherein three volumetric parallel modules are created upon combining of the outer module, the inner module and the synthetic module.

2. The light weight parallel modular living unit of claim 1, further comprising:

an outer module ceiling panel secured to top surfaces of the one or more outer module exterior wall panels;

an inner module ceiling panel secured to top surfaces of the one or more inner module exterior wall panels; and a synthetic ceiling panel secured to the one or more outer module exterior wall panels and the one or more inner module exterior wall panels forming the synthetic module.

3. The light weight parallel modular living unit of claim 1, further comprising at least one synthetic exterior wall panel joining the inner module to the outer module.

4. The light weight parallel modular living unit of claim 1, wherein each wall panel in one or more outer module exterior wall panels, the one or more outer module interior wall panels, the one or more inner module exterior wall panels and the one or more inner module interior wall panels are made from light gauge steel.

5. The light weight parallel modular living unit of claim 1, wherein the inner and outer modules are prefabricated;

wherein each wall panel in one or more outer module exterior wall panels, the one or more outer module interior wall panels, the one or more inner module exterior wall panels, the one or more inner module interior wall panels, the outer module ceiling panel, the inner module ceiling panel and the synthetic ceiling panel are fabricated during a first stage; and wherein the inner and outer modules are fabricated during a second stage.

6. A light weight parallel multi-family building structure including multiple parallel modular living units, the structure comprising:

A. a first plurality of parallel modular living units, where each living unit in the first plurality of living units comprise:

(i) a first outer module having one or more outer module exterior wall panels joined together forming an outer end wall, an opposing inner end wall, and a pair of outer sidewalls;

(ii) a first inner module having one or more outer module interior wall panels located within the interior of the outer module and affixed to the outer end wall and/or the inner end wall; and (iii) a first synthetic residential module located between the first outer module and the first inner module and formed by the inner end wall of the outer module and the inner end wall of the inner module;

B. a second plurality of parallel modular living units located parallel to the first plurality of parallel modular living units, where each living unit in the second plurality of parallel modular living units comprise:

(i) a second outer module having one or more outer module exterior wall panels joined together forming an outer end wall, an opposing inner end wall, and a pair of outer sidewalls;

(ii) a second inner module having one or more outer module interior wall panels located within the interior of the outer module and affixed to the outer end wall and/or the inner end wall; and (iii) a second synthetic residential module between the second outer module and the second inner module formed by the inner end wall of the outer module and the inner end wall of the inner module; and C. a double loaded synthetic corridor module formed by the first inner module of the each living unit in the first plurality of living units and the second inner module in the second plurality of living units, the doubled loaded synthetic corridor module located between, and parallel to, the first and second synthetic residential modules; and D. wherein the light weight parallel multi-family building structure having an exterior front wall, an exterior rear wall, and a pair of exterior side walls, where the exterior front wall, the exterior rear wall, and the pair of exterior side walls are integrally connected;

E. wherein seven volumetric modules are created upon combining of the outer modules, the inner modules and the synthetic residential modules; and F. wherein each of the seven volumetric modules are parallel relative to the exterior front wall of the light weight parallel multi-family building structure and the exterior rear wall of the light weight parallel multi-family building structure.

7. The multi-family building structure of claim 6, wherein the first inner module of the each living unit in the first plurality of parallel modular living units and the second inner module in the second plurality of parallel modular living units house utility connections.

8. The multi-family building structure of claim 6, wherein each living unit in the first plurality of parallel module living units further comprises:

a first outer module ceiling panel secured to top surfaces of the one or more first outer module exterior wall panels;

a first inner module ceiling panel secured to top surfaces of the one or more first inner module exterior wall panels; and a first synthetic residential ceiling panel secured to the one or more first outer module exterior wall panels and the one or more first inner module exterior wall panels forming the first synthetic residential module.

9. The multi-family building structure of claim 6, wherein each living unit in the second plurality of parallel modular living units further comprises:

a second outer module ceiling panel secured to top surfaces of the one or more second outer module exterior wall panels;

a second inner module ceiling panel secured to top surfaces of the one or more second inner module exterior wall panels; and a second synthetic residential ceiling panel secured to the one or more second outer module exterior wall panels and the one or more second inner module exterior wall panels forming the second synthetic residential module.

10. The multi-family building structure of claim 6, wherein the parallel modular living units in first plurality of parallel modular living units and the parallel modular living units in the second plurality of parallel modular living units are located directly across the synthetic corridor module from each other and include load bearing walls which mirror each other.

11. The multi-family building structure of claim 6, further comprising:

a third plurality of parallel modular living units stacked on top of the first plurality of parallel modular living units, where each living unit in the third plurality of parallel modular living units comprise:

a third outer module;

a third inner module; and a third synthetic residential module between the third outer module and the third inner module;

a fourth plurality of parallel modular living units stacked on top of the second plurality of parallel modular living units, where each living unit in the fourth plurality of living units comprise:

a fourth outer module;

a fourth inner module; and a fourth synthetic residential module between the fourth outer module and the fourth inner module; and a second synthetic corridor module formed between the third inner module of the each living unit in the third plurality of parallel modular living units and the fourth inner module in the fourth plurality of parallel modular living units.

12. The multi-family building structure of claim 6, further comprising:

a first synthetic residential module side wall panel connected between the first outer module and the first inner module at a first end of the first synthetic module;

a second synthetic residential module side wall panel connected between the first outer module and the first inner module at a second opposing end of the first synthetic module; and a first synthetic residential module ceiling panel placed on top of the first synthetic residential panel.

13. The light weight parallel modular weight living unit of claim 1, wherein the inner module houses utility connections.

14. The light weight parallel multi-family building structure of claim 6, wherein each wall panel in one or more outer module exterior wall panels, the one or more outer module interior wall panels, the one or more inner module exterior wall panels and the one or more inner module interior wall panels are made from light gauge steel.

15. The light weight parallel multi-family building structure of claim 6, wherein the inner and outer modules are prefabricated;

wherein each wall panel in one or more outer module exterior wall panels, the one or more outer module interior wall panels, the one or more inner module exterior wall panels, the one or more inner module interior wall panels, the outer module ceiling panel, the inner module ceiling panel and the synthetic ceiling panel are fabricated during a first stage; and wherein the inner and outer modules are fabricated during a second stage.

* * * * *